US005513835A

United States Patent [19]

Lonardi et al.

[11] Patent Number: 5,513,835

[45] Date of Patent: May 7, 1996

[54] DISTRIBUTING CHUTE FOR A FURNACE

[75] Inventors: Emile Lonardi, Bascharage; Giovanni Cimenti, Fentange; Radomir Andonov, Mamer; Joseph Hollman, Olm; Guy Thillen, Diekirch, all of Luxembourg

[73] Assignee: Paul Wurth S.A., Luxembourg

[21] Appl. No.: 298,995

[22] Filed: Aug. 31, 1994

[30] Foreign Application Priority Data

Sep. 1, 1993 [LU] Luxembourg ..... 88399

[51] Int. Cl.[6] ..... C21B 7/16

[52] U.S. Cl. ..... 266/176; 266/190; 266/191

[58] Field of Search ..... 266/176, 190, 266/191; 222/592

[56] References Cited

U.S. PATENT DOCUMENTS 3,899,088 8/1975 Furuya et al. ..... 266/176

4,599,028 7/1986 Mahr et al. ..... 266/176

FOREIGN PATENT DOCUMENTS 3274708 11/1988 Japan ..... 266/176

*Primary Examiner*—Scott Kastler

*Attorney, Agent, or Firm*—Fishman, Dionne & Cantor

[57] ABSTRACT

A distributing chute for installation in a furnace, particularly suitable for use in a bell-less charging system of a blast furnace, comprises heat-resistant ceramic tiles on its underside. These ceramic tiles are inserted between, and secured by, hollow sections which are attached to the chute body and through which a cooling medium is passed. The ceramic tiles preferably include lateral grooves; the hollow sections being fitted in the lateral grooves for securing the ceramic tiles.

20 Claims, 3 Drawing Sheets

Fig. 1a
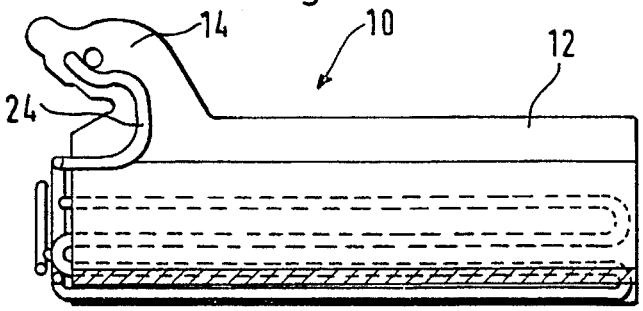
Fig. 1c
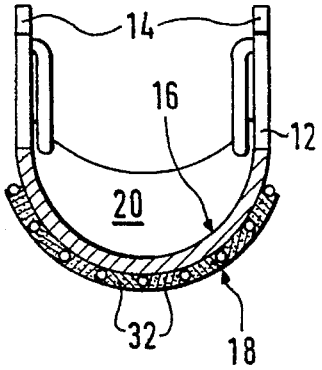
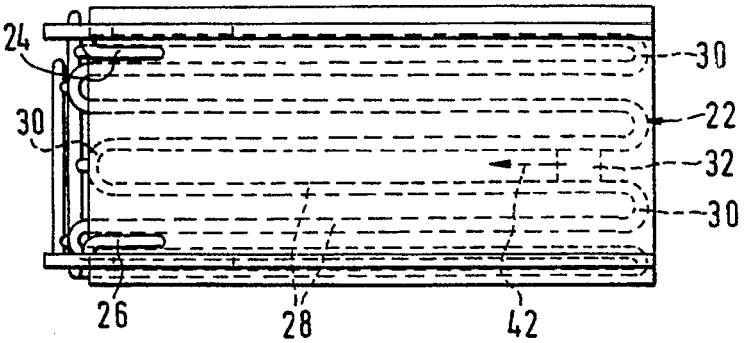
Fig. 1b
Fig. 2a
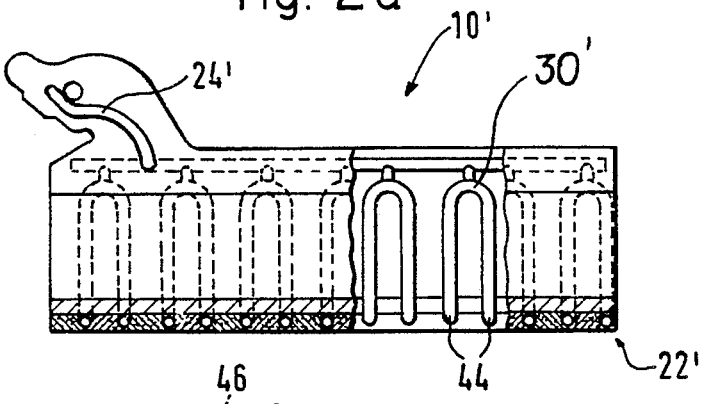
Fig. 2c
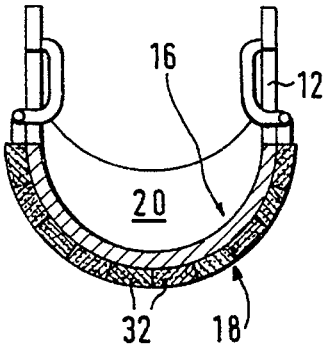
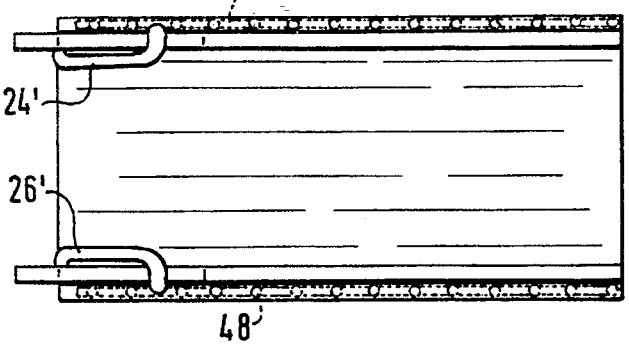
Fig. 2b Fig. 3a
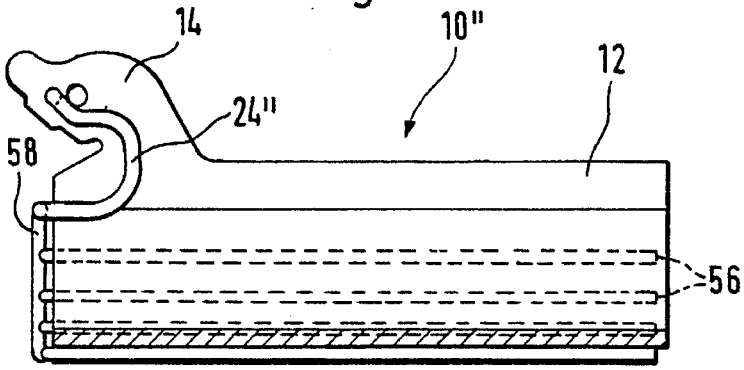
Fig. 3c
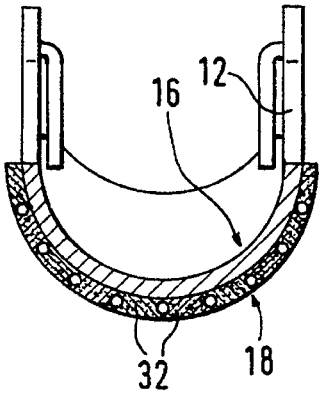
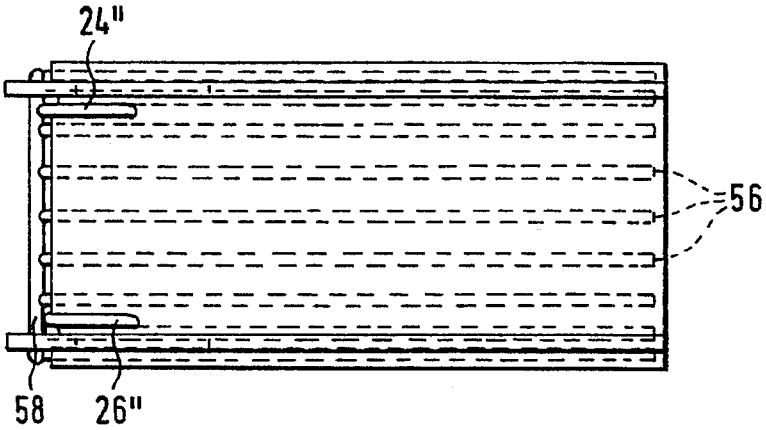
Fig. 3b
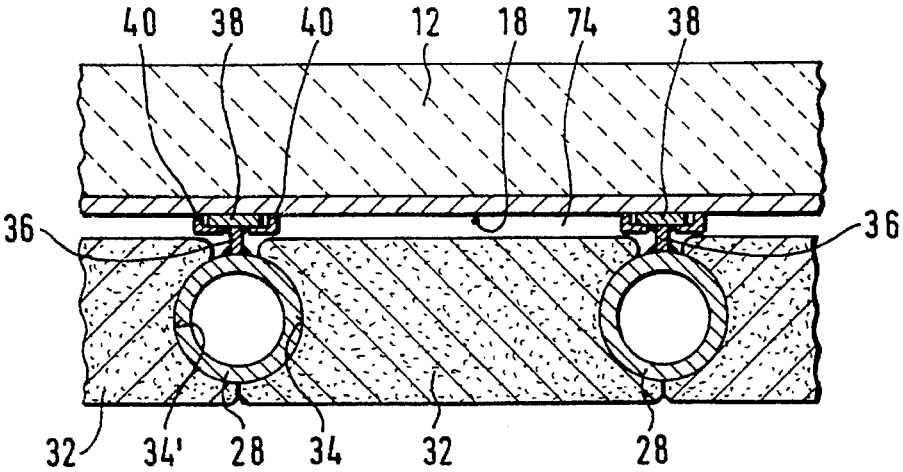
Fig. 4

DISTRIBUTING CHUTE FOR A FURNACE

BACKGROUND OF THE INVENTION

This invention relates generally to a distributing chute for a furnace. More particularly, this invention relates to a distributing chute which is particularly well suited suited for use in a bell-less charging system of a blast furnace.

A bell-less charging system for a blast furnace is, for example, known from U.S. Pat. No. 3,880,302, all of the contents of which are incorporated herein by reference. It comprises a distributing chute which is mounted in the top of the blast furnace in a rotatable, pivotable manner. The underside of the distributing chute is subjected to the full heat radiation from the surface of the charge in the blast furnace.

Whereas it was possible until recently to do without a means of heat insulation on the underside of the distributing chute, this is no longer the case where contemporary blast furnace operating practice is concerned. For example, due to the injection of increasingly large quantities of pulverized coal into the blast furnace, the temperature at the surface of the charge may exceed 1000° C. The underside of the chute is thus subjected to more and more intense heat radiation. Above a certain temperature, however, the high-temperature resistant steels of the chute body lose their heat-resistant quality and corrosion appears.

Various heat insulating devices for the underside of the distributing chute have been proposed to correct this problem. A double-walled distributing chute which is cooled by means of an inert gas is known from GB-A-1,487,527, all of the contents of which are incorprated herein by reference. However, the effectiveness of this cooling is ensured only if very high gas throughputs are employed. However, feeding of large gas throughputs into a rotatable, pivotable chute is problematic and difficult to achieve.

An improved means of heat insulation for the underside of the distributing chute is known from U.S. Pat. No. 5,252,063, all of the conents of which are incorporated herein by reference. The improved heat insulation is mainly achieved by means of an improved device for feeding the cooling medium into the rotatable, pivotable distributing chute. This proposed feeding device enables either a higher gas throughput through the chute or, preferably, cooling of the chute with cooling water in a closed cooling circuit. For the cooling water, one or two U-shaped cooling ducts are longitudinally mounted on the underside of the distributing chute and connected to a cooling water distribution system through the suspension shafts of the distributing chute. In DE-4216166 it is furthermore proposed that the cooling ducts be provided with cooling fins or gills in order to achieve more uniform cooling of the underside and/or that the cooling ducts be embedded in a refractory material (e.g. a heat-insulating concrete).

Practical experience has shown in the meantime that embedding of the cooling ducts in a refractory material is emphatically recommended in order to protect the cooling ducts themselves as well as the underside of the distributing chute more effectively from the heat radiation (and from the generally hostile and severe conditions which prevail above the surface of the charge). Without the additional heat insulation of the refractory material, the throughput of the cooling medium would have to be increased substantially and the cooling ducts would have to be laid very close together on the chute body, both of which are not easily feasible.

Unfortunately it has also been discovered in the meantime that the refractory material in which the cooling ducts are embedded develops cracks relatively quickly in the furnace and crumbles away from or drops off the underside of the chute in relatively large, slab-like pieces.

SUMMARY OF THE INVENTION

The above-discussed and other problems and deficiencies of the prior art are overcome or alleviated by the distributing chute for a furnace device (e.g., shaft furnace) of the present invention. In accordance with the present invention, a distributing chute is provided for which the underside is more durably protected from the heat radiation in the furnace. This is achieved by providing heat resistant ceramic tiles affixed to the underside of the distributing chute. The heat-resistant ceramic tiles are inserted between, and secured by, hollow sections. These hollow sections are fixed to the chute body and connected to a distribution circuit for a cooling fluid. The cooling fluid may be a liquid, a gas or a vapor.

In the context of the present invention, it was initially necessary to solve the problem of whether ceramic tiles could be mounted on the underside of a rotatable, pivotable distributing chute at all and how such tiles should be attached to the chute body.

It is conventional practice to fix refractory ceramic tiles on to static furnace walls by means of heat-resistant bolts and cramps. For this, there must be adequate axial and radial play between the ceramic tile and the mounting, so that the ceramic tiles do not crack when the mountings cool down or heat up. In the course of developing the present invention, this conventional fixing practice was considered for fixing refractory ceramic tiles to the underside of the distributing chute. It was however discovered that even if the axial and radial play between the ceramic tile and the mounting is adequately dimensioned to absorb the thermal deformation of the mountings, cracks formed in the ceramic tiles in the area of the mountings. These cracks could be explained by the fact that in addition to the thermal stress, the distributing chute is subjected to dynamic stress, that is, vibration, jarring and shocks. Excessive play of the ceramic tiles in their mountings, especially at right angles to the underside of the chute, therefore significantly accelerates the cracking of the ceramic tiles.

By the cooling of the hollow sections, which in the case of the chute in accordance with the present invention serve as mountings for the tiles, the typical thermal deformation of the mountings was greatly reduced. The play of the ceramic tiles in the cooled hollow sections, especially at right angles to the underside of the chute, was thereby reduced. As a result, the ceramic tiles were in turn subjected to less dynamic stress from vibration, jarring and shocks. Furthermore, as a side affect, the durability of the mountings was increased by their cooling.

The ceramic tiles gave far better protection of the underside of the chute against heat radiation than a heat-insulating concrete. As a result, the required cooling capacity of the cooling medium may be reduced. A reduced cooling capacity has a favorable effect on the dimensioning of the connections for the cooling medium and in principle permits the use of a gaseous cooling medium.

The ceramic tiles generally have better mechanical properties than a castable heat-insulating material. In this context, it should also be noted that the size of the ceramic tiles predetermines the maximum size of fragments in the event of cracking. These fragments are generally smaller than the large, slab-like pieces crumbling away from the underside of the chute in the case of the heat-insulating concrete used on the known prior art chutes. The maximum crack propagation in the tiles is fixed by the individual size of each tile, the crack propagation being halted at the tile edges at the maximum. Continuous cracks over the entire length or width of the chute, which have been observed where heat-insulating concrete is used, are thus effectively prevented.

To secure the ceramic tiles in the cooled hollow sections, the hollow sections might, for example, be provided with a groove in which the ceramic tiles may be engaged. However, it is more advantageous if, to secure the ceramic tiles, the cooled hollow sections can be engaged in a lateral groove in the ceramic tiles in such a way that the hollow sections are largely covered by the ceramic tiles. In this embodiment the hollow sections are shielded from direct heat radiation by the ceramic tiles, which has a beneficial effect on their lifespan.

With regard to the choice of cross-section for the hollow sections, there are of course innumerable possibilities. In the case of hollow sections with a circular cross-section, the cross-section of the groove in the ceramic tiles roughly corresponds to one half of this circular cross section. Hollow sections with a circular cross-section are manufactured as standard products in various high-temperature, high-strength steels. Due to the cylindrical contact surface between the hollow sections and the ceramic tiles, no substantial stress concentrations arise in the ceramic tiles, whether due to thermal deformation or due to dynamic forces. Furthermore, a circular inside cross-section means reduced pressure drops for the cooling medium.

Similar benefits are achieved by hollow sections with an oval cross-section. With an oval cross-section, the contact surface between the hollow section and the ceramic tile is larger than with a circular cross-section. This reduces the likelihood of pieces breaking off the groove in the ceramic tile. Trouble-free guidance of the ceramic tiles in the hollow sections is still ensured if the distance between two adjacent hollow sections increases.

For the fitting of the ceramic tiles it is advantageous if the hollow sections can be fixed to the chute body first and the ceramic tiles can then each be inserted between two of the hollow sections which are fixed to the chute body at a certain distance apart. With this embodiment it is possible to replace damaged ceramic tiles without having to dismantle all the hollow sections.

Practical experience has shown that the distance between two hollow sections should not exceed 200 mm. The length of the ceramic tiles is preferably less than 300 mm. If these maximum tile dimensions are adhered to, the susceptibility of the ceramic tiles to cracking can be greatly reduced.

To enable insertion of the ceramic tiles, hollow sections arranged parallel to each other are joined together at their ends with cross-pieces in a serpentine configuration. The ceramic tiles may then each be inserted between two adjacent hollow sections. Connections for the cooling medium are advantageously located in the area of the cross-pieces, so as not to impede insertion of the ceramic tiles.

The hollow sections may run parallel to the longitudinal axis of the chute as straight lengths of tube, which facilitates the insertion of the ceramic tiles and permits longer tiles to be used. However, the hollow sections may also run perpendicular to the longitudinal axis of the chute and take the form of arch-shaped tube segments. The arch-shaped tube segment arrangement has advantages with regard to the distribution of the cooling medium and reduced consequences of thermally induced deformation of the chute cross-section.

The hollow sections are preferably not welded to the chute body but are supported on the underside of the distributing chute by means of a base surface and mechanical fixing means so that they may expand axially. Welding the hollow sections on the underside of the distributing chute would cause the latter to be subjected to thermal stresses when the chute body heats up or cools down. The relatively poor heat transmission between the freely supported hollow sections and the chute body can be compensated for, at least in part, by making the heat transmission area as large as possible (i.e. by using the largest possible base surface).

An advantageous embodiment of the present invention features a T-section axially welded by its web to a straight length of tube and the flange of the T-section attached to the underside of the chute, parallel to the centerline of the chute, so that it may expand axially.

Another advantageous embodiment of the present invention provides several supporting sections movably attached to the underside of the chute, parallel to the centerline of the chute, and arch-shaped tube segments transversely welded to these supporting sections.

A cavity is preferably formed between the chute body and the ceramic tiles. This cavity may either be filled with an insulating material (e.g. ceramic wool) or a cooling gas may be passed through it.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES:

FIG. 1A shows a longitudinal section of a first preferred embodiment of a distributing chute in accordance with the present invention;

FIG. 1B shows a top view of the distributing chute shown in FIG. 1A;

FIG. 1C shows a cross section view of the distributing chute shown in FIG. 1A;

FIG. 2A shows a longitudinal section of a second preferred embodiment of a distributing chute in accordance with the present invention;

FIG. 2B shows a top view of the distributing chute shown in FIG. 2A;

FIG. 2C shows a cross section view of the distributing chute shown in FIG. 2A;

FIG. 3A shows a longitudinal section of a third preferred embodiment of a distributing chute in accordance with the present invention;

FIG. 3B shows a top view of the distributing chute shown in FIG. 3A;

FIG. 3C shows a cross section view of the distributing chute shown in FIG. 3A;

FIG. 4 shows a detail of a preferred means of fixing the hollow sections;

DESCRIPTION OF THE PREFERRED EMBODIMENT

Figure 5:
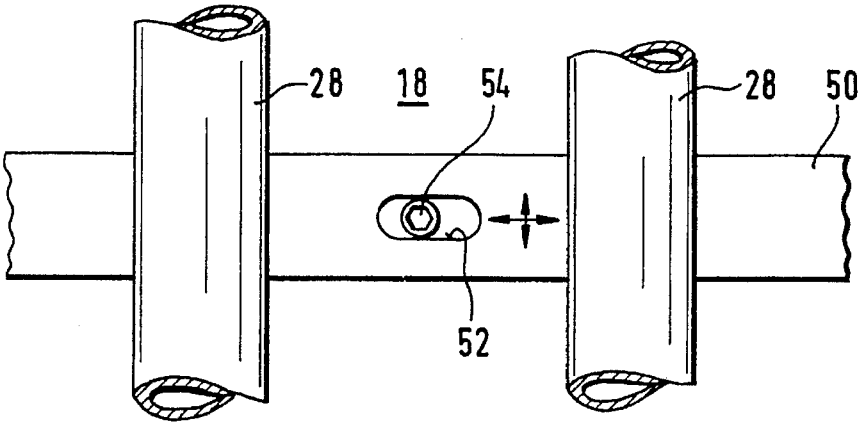
FIG. 5 shows a detail of a second preferred means of fixing the hollow sections.

Referring first to FIGS. 1A, 1B and 1C, the distributing chute for a furnace device of the present invention is shown generally at 10. Device 10 has a chute body 12 with a semicircular cross-section. The chute cross-section could of course also be oval, trapezoidal or triangular. The chute could also be bounded by a lateral surface on only one side or on neither side.

At one end, its top end, the chute body 12 has a suspension device 14 for suspending the distributing chute 10 in a driving device which is not shown. This driving device is located above the surface of the charge in a furnace (for example, in the top of a blast furnace). It causes the chute 10 to pivot about a horizontal axis in order to adjust the angle of inclination of the chute, and to rotate about a vertical axis in order to distribute the bulk material circularly onto the surface of the charge.

The chute 10 has a top side 16 and an underside 18. A chute channel 20 is formed at the top side 16 of the distributing chute. Although this top side 16 is subject in the chute channel 20 to severe abrasive stress on account of the bulk material, it is not directly subjected to the very intense heat radiation from the surface of the charge in the furnace. The underside 18, on the other hand, is subjected to the full heat radiation in the furnace, especially when the chute 10 is in a near-horizontal position.

In the embodiments shown in FIGS. 1A, 1B, 1C and 2A, 2B, and 2C, the underside 18 of the distributing chute 10 is provided with a tube coil 22, 22' which is connected by connecting means (the connections 24, 26 and, respectively, 24', 26') to the feed line and, respectively, the return line of a cooling fluid distribution circuit which is not shown. This connection is accomplished, for example, as described in aforementioned DE-4216166, by ducts which run axially through the suspension shafts of the chute and are connected via rotary connections to a ring-shaped intermediate tank for a cooling liquid (e.g. cooling water) which turns with the chute 10.

In FIGS. 1A, 1B and 1C the tube coil 22 comprises several parallel straight lengths of tube 28 which run parallel to the longitudinal axis of the chute 10 and are joined to each other at their ends by elbows 30 in a serpentine configuration. The axial distance between the straight lengths of tube 28 is, for example, approximately 20 cm. Refractory ceramic tiles 32 are fitted between every two adjacent straight lengths of tube 28. In FIG. 4 it is seen that the ceramic tiles 32 have a groove 34 of semicircular cross-section on each of two opposing long sides. A straight length of tube 28 with a circular cross-section engages positively with this groove 34 in such a way that the groove 34 of the first ceramic tile receives the first half of the tube cross-section and the groove 34' of the adjacent second ceramic tile 32 receives the second half of the tube cross-section. The straight lengths of tube 28 are thus completely covered externally by the ceramic tiles 32. It should be emphasized that due to the cooling of the straight lengths of tube 28, their cross-section does not undergo any significant thermal deformation. As a result, the fit between the groove 34 and the groove 34' and the outside cross-section of the lengths of tube 28 can be designed with relatively little play, which results in substantially less mechanical stress on the ceramic elements 32 due to vibration, jarring, shocks, etc.

When installing the heat insulation of the chute 10, it is preferable first to fix the tube coil 22 to the underside 18 of the chute. An advantageous method of fixing the tube coil 22 to the chute body 12 is shown in FIG. 4. T-sections 36 are welded on to the straight lengths of tube 28 with their webs parallel to the centerline of the tube. The flange of the T-section 36 forms a support surface 38 for the corresponding length of tube 28 on the underside 18 of the chute 10. The larger the area of this support surface 38, the better is the heat transmission between the chute body 12 and the tube coil 22 and thus the cooling of the chute body 12. These T-sections 36 are fixed on to the chute body 12 in such a way that an axial freedom of movement is preserved between the chute body 12 and the T-sections 36. This allows the chute body 12 and the straight lengths of tube 22 to expand thermally independently of each other. To achieve this, for example, the flange of the T-section 36 is fixed to the underside 18 of the chute with cramps 40, as indicated in FIG. 4. However, the flange of the T-section 36 could also have oblong holes for bolts. The fixing method described above makes the tube coil 22 largely independent of longitudinal thermal deformations of the chute body 12. The tube coil 22 is thus subject only to smaller deformations caused mainly by thermal deformation of the cross-section of the chute body 12. The tube coil 22 could of course also form a self-supporting cage suspended from the chute body 12 in such a way that it is largely independent of thermally induced deformations in the longitudinal and cross sections of the chute body 12.

The ceramic tiles 32 are insertable between the tubes of the tube coil 22 fixed to the chute body 12. This insertion of the ceramic tiles 32, which are about 30 cm in length, takes place between two adjacent elbows 30 in the direction of the elbow 30 which joins the two straight lengths of tube 28 serving as guides for the inserted ceramic tile 32 (see the arrow 42 in FIGS. 1A, 1B and 1C). The elbows 30 which ultimately remain exposed may subsequently be cast into an insulating material (e.g. a heat-insulating concrete).

The unions between the connections 24, 26 for the liquid cooling medium and the tube coil 22 are advantageously made at the top end of the chute 10 in the area of the elbows 30. In this way the previously described insertion of the ceramic tiles 32 is not impeded. In FIGS. 1A, 1B and 1C, the elbows 30 are, for example, alternately connected to the supply pipe 24 and the supply pipe 26. As a result, the hydraulic length of the tube coil 22 is equal to the length of two lengths of tube 28. To protect the supply pipes 24, 26 at the top end of the chute from heat radiation, they may be embedded in an insulating material (e.g. a heat-insulating concrete).

The distributing chute 10' shown in FIGS. 2A, 2B and 2C has, in place of the tube coil 22 with straight lengths of tube 28 shown in FIGS. 1A, 1B and 1C, a tube coil 22' with arch-shaped tube segments 44. The arch shaped tube segments 44 are arranged parallel to each other and at right angles to the centerline of the chute and are axially spaced approximately 20 cm apart. These arch-shaped tube segments 44 are connected at their ends by elbows 30' in a serpentine configuration. The connecting pipes 24', 26' are connected to the elbows 30' by two collectors 46, 48 which are arranged laterally on the chute body 12. The hydraulic length of the tube coil 22' is therefore substantially shorter than the hydraulic length of the tube coil 22, as a result of which the pressure drop in the tube coil 22' is substantially smaller. This may be important, as the effective head of the cooling liquid is often very small.

FIG. 5 shows a preferred method of fixing of the arch-shaped tube segments 44. Flat bars or sections 50 are fixed to the underside 18 of the chute 10' parallel to its longitudinal axis in such a way that an axial freedom of movement is preserved between the chute body 12 and the flat bars or sections 50. This permits the chute body 12 and the flat bars or sections 50 to expand thermally independently of each other. This is achieved, for example, in that the flat bars or sections 50 are provided with oblong holes 52 and are fastened to the chute body when cold with bolts or rivets 54. However, the flat bars or sections 50 may instead be fixed with clamps. The arch-shaped tube segments 44 are preferably welded on to these flat bars or sections 50 in such a way that good heat transmission between the tube segments 44 and the flat bars or sections 50 is achieved as far as possible. By good heat transmission, it is meant that good cooling of the flat bars or sections 50 is achieved, with the result that the latter are subject to relatively small thermally induced changes in length. Due to the previously described method of fixing of the tube coil 22', the tube coil 22' undergoes hardly any deformation due to thermally induced longitudinal deformations of the chute body 12. Thermally induced deformations of the cross-section of the chute body 12 have, in the case of the design of the tube coil 22', practically no influence on the lateral play of the ceramic tiles 32 in their curved tube guides.

FIGS. 3A, 3B and 3C shows an alternative preferred embodiment for a gaseous cooling fluid. Instead of a tube coil 22, 22', the chute 10" has several parallel straight lengths of tube 56 which are joined at the top end of the distributing chute 10" to appropriate cooling gas connections 24", 26" via an arch-shaped cooling gas collector 58. At their opposite ends, on the other hand, the parallel tubes 56 are open, allowing the cooling gas to flow freely into the furnace.

Figure 6:
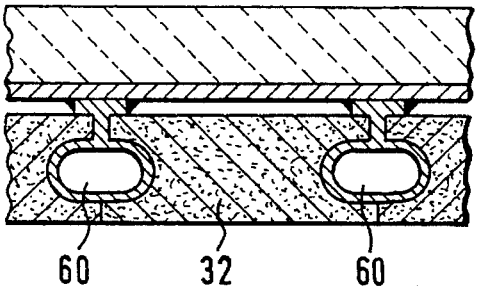
FIGS. 6, 7 and 8 show alternative hollow section cross sections of the distributing chutes of the invention.

FIGS. 6 to 9 each show alternative embodiments of the invention with various hollow sections. FIG. 6 shows hollow sections 60 with an oval cross-section. These have essentially similar advantages to hollow sections with a circular cross-section, but have two parallel guide surfaces for the ceramic elements 32 at right angles to the underside of the chute. Even if the axial distance between two oval hollow sections greatly increases due to thermal deformation of the chute, it is ensured that the ceramic tiles 32 are still properly secured and guided. As the hollow sections 60 do not undergo any substantial deformation, the play between the groove and the hollow sections 60 at right angles to the underside of the chute may be made relatively small.

Figure 7:
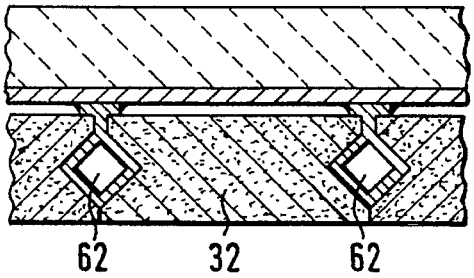

FIG. 7 shows hollow sections 62 with a square cross section. This design is much more prone to crack formation in the ceramic tiles 32 than the designs in which the hollow sections have a circular or oval cross-section.

Figure 8:
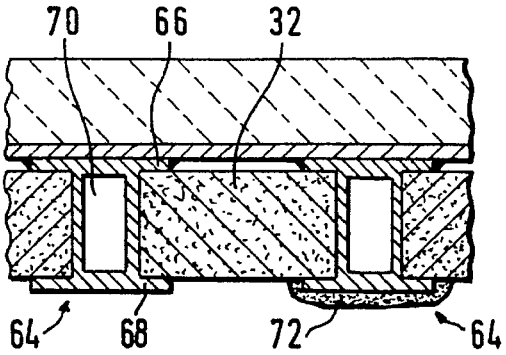

FIG. 8 shows an alternative embodiment in which the supporting section 64 has two solid flanges 66 and 68 and a cooled hollow web 70. The cooled web is subject to smaller thermal deformations than a non-cooled web, with the result that good guidance of the ceramic tiles between the two flanges 66 and 68 is ensured even if the chute 10 is heated to a high temperature. The flange 68 is not covered by the ceramic tiles 32 and is thus directly subjected to the heat radiation. However, it may be additionally protected from heat radiation in the furnace by means of an insulating material 72 (e.g. a heat-insulating concrete) applied on top, as indicated in FIG. 8.

It will be appreciated that a cavity 74 (see FIG. 4) is advantageously formed between the ceramic tiles 32 and the underside 18 of the chute; thus the ceramic tiles do not lie directly on the underside 18 of the chute. This cavity 74 is preferably filled with a soft insulating material (e.g. ceramic wool); this insulating material both improves the thermal insulation of the underside 18 of the chute and dampens vibrations of the ceramic tiles 32 in the hollow sections at right angles to the underside 18 of the chute. In the case of a gas-cooled distributing chute 10", the gaseous cooling medium may also be passed through this cavity 74.

In FIGS. 3A, 3B and 3C the gaseous cooling medium is fed into the cavity 74 through, for example, radial drilled holes in the straight tube lengths 56.

While preferred embodiments have been shown and described, various modifications and substitutions may be made thereto without department from the spirit and scope of the invention accordingly, it is to be understood that the present invention has been described by way of illustrations and not limitation.

What is claimed is:

1. A distributing chute for a furnace comprising:

a chute body with a top side and an underside, said top side forming a chute channel, said underside being at least partly subjected to radiant heat in the furnace;

hollow tube sections attached to said underside of said chute body and forming a plurality of spaced apart tube sections for the flow of a cooling fluid, each of said tube sections having a shaped outer surface;

connecting means for connecting said hollow tube sections to a cooling fluid distribution circuit; and a plurality of heat-resistant ceramic tiles positioned between, and secured by, said hollow tube sections, each of said ceramic tiles having two opposed edges shaped to engage and form a complementary fit with adjacent pairs of said hollow tube sections.

2. The device of claim 1, wherein said ceramic tiles include lateral grooves, said hollow tube sections being fitted in said lateral grooves for securing said ceramic tiles.

3. The device of claim 2, wherein said hollow tube sections are substantially covered by said ceramic tiles.

4. The device of claim 3, wherein said hollow tube sections have a circular cross-section and the cross-section of said groove in said ceramic tiles corresponds approximately to one half of said circular cross-section, giving a substantially complimentary fit.

5. The device of claim 3, wherein said hollow tube sections have an oval cross-section and the cross-section of said groove in said ceramic tiles corresponds approximately to one half of said oval cross-section, giving a substantially complimentary fit.

6. The device of claim 5, wherein said hollow tube section are fixed to said chute body and wherein said ceramic tiles are each insertable between two of said hollow tube sections.

7. The device of claim 6, wherein the distance between two hollow tube sections does not exceed 200 mm and the length of said ceramic tiles do not exceed 300 min.

8. The device of claim 1, wherein said hollow tube sections each have ends and wherein said hollow tube sections are arranged parallel to each other and joined together at said respective ends by cross-pieces to form a cooling coil.

9. The device of claim 8, wherein said cooling coil has a serpentine configuration.

10. The device of claim 9, wherein a plurality of said cross-pieces are equipped with connections for communication with cooling fluid.

11. The device of claim 1, wherein said chute body has a longitudinal axis and wherein said hollow tube sections have the form of straight lengths of tube running parallel to said longitudinal axis of said chute body.

12. The device of claim 1, wherein said chute body has a longitudinal axis and wherein said chute has a semicircular cross-section and said hollow tube sections have the form of arch-shaped tube segments running transversely to said longitudinal axis of said chute.

13. The device of claim 1, wherein said hollow tube sections are freely supported on said underside of said distributing chute by base surfaces, said base surfaces being fixed to said underside of said distributing chute so as to be expandable in the longitudinal direction of said chute.

14. The device of claim 11, wherein said hollow tube sections are freely supported on said underside of said distributing chute by base surfaces, said base surfaces being fixed to said underside of said distributing chute so as to be expandable in the longitudinal direction of said chute.

15. The device of claim 14, including T-sections having webs and flanges wherein said T-sections are axially welded by said webs to said straight tube lengths and said flanges of said T-sections are fixed to said underside of the chute in such a way that said T-sections are axially movable.

16. The device of claim 13, including supporting sections fixed to said underside of said chute wherein said supporting sections are axially movable and including arch-shaped tube segments transversely welded to said supporting sections.

17. The device of claim 1, including a cavity formed between said chute body and said ceramic tiles.

18. A distributing chute for a furnace comprising:

a chute body having a top side and an underside, said top side forming a chute channel for delivery of material to a furnace, and said underside being at least partly exposed to radiant heat when in a furnace;

flow tube means supported on and spaced from said underside of said chute body, said flow tube means forming a plurality of generally parallel spaced apart flow tube sections for the flow of a cooling fluid, each of said parallel flow tube sections having an exterior surface of predetermined contour; and a plurality of heat resistant ceramic tiles positioned between and mounted on said parallel flow tube sections, said ceramic tiles being spaced from said underside of said chute, and each of said ceramic tiles having two opposed edges shaped complementarily to said predetermined contour of said flow tube sections to form a complementary fit with adjacent pairs of said parallel flow tube sections.

19. The device of claim 18 wherein:

said flow tube sections are circular in cross-section, and said opposed edges of each of said ceramic tiles is semicircular.

20. The device of claim 19 wherein said flow tube sections are substantially covered by said ceramic tiles.

* * * * *